US011162354B2

(12) United States Patent
Rogacheva et al.

(10) Patent No.: US 11,162,354 B2
(45) Date of Patent: Nov. 2, 2021

(54) COMMUNICATION SYSTEMS AND METHODS

(71) Applicant: Expro North Sea Limited, Dyce (GB)

(72) Inventors: Alexandra Vasil'evna Rogacheva, Southampton (GB); Brian Phillip Champion, Wimborne (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 16/345,113

(22) PCT Filed: Oct. 25, 2017

(86) PCT No.: PCT/GB2017/053211
§ 371 (c)(1),
(2) Date: Apr. 25, 2019

(87) PCT Pub. No.: WO2018/078356
PCT Pub. Date: May 3, 2018

(65) Prior Publication Data

US 2019/0284928 A1 Sep. 19, 2019

(30) Foreign Application Priority Data

Oct. 25, 2016 (GB) ..... 1617956.6

(51) Int. Cl.
*E21B 47/13* (2012.01)
*E21B 33/12* (2006.01)
*E21B 47/07* (2012.01)

(52) U.S. Cl.
CPC ..... *E21B 47/13* (2020.05); *E21B 33/1204* (2013.01); *E21B 33/1208* (2013.01); *E21B 47/07* (2020.05)

(58) Field of Classification Search
CPC ..... E21B 47/121; E21B 47/122; H04B 13/02
See application file for complete search history.

(56) References Cited

U.S. PATENT DOCUMENTS 3,831,138 A * 8/1974 Rammner ..... E21B 47/06 367/81
3,967,201 A * 6/1976 Rorden ..... E21B 47/122 340/854.5
5,576,703 A 11/1996 MacLeod et al.
2011/0205080 A1 8/2011 Millot et al.
(Continued)

OTHER PUBLICATIONS

Champion et al. "Reducing Reservoir Uncertainty During Appraisal and Development—Novel Applications of a New Wireless Reservoir Monitoring Technology in Santos Basin Pre-Salt", SPE Annual Technical Conference and Exhibition, Sep. 28, 2015.
(Continued)

*Primary Examiner* — Cathleen R Hutchins
(74) *Attorney, Agent, or Firm* — Getz Balich LLC

(57) ABSTRACT

In described examples, there are systems and methods for deployment in proximity to an abandoned well. The systems and methods may allow use of data collected from an abandoned well, in which a sensor is positioned in the open hole section, or a well having a discontinuous metallic well structure. In some examples, there is described a communication system that is configured to be deployed in an abandoned well having a discontinuous metallic well structure that may be severed below a ground region.

18 Claims, 7 Drawing Sheets

(56) References Cited

U.S. PATENT DOCUMENTS

| | | | | |
|---|---|---|---|---|
| 2013/0133883 | A1* | 5/2013 | Hill, Jr. | E21B 33/10 166/250.17 |
| 2015/0267530 | A1* | 9/2015 | Hudson | E21B 47/13 166/381 |

OTHER PUBLICATIONS

Exprogroup, "Wireless Well Solutions CaTS Cableless Telemetry System", Aug. 17, 2016.

Champion et al. "Clair Field: Reducing Uncertainty in Reservoir Connectivity During Reservoir Appraisal—A First Time Application of a New Wireless Pressure Monitoring Technology in an Abandoned Subsea Appraisal Well", Offshore Europe, Jan. 1, 2007.

Quint et al. "4D Pressure Pilot to Steer Well Spacing in Tight Gas", SPCE Annual Technical Conference and Exhibition, Jan. 1, 2006, pp. 24-27.

* cited by examiner

COMMUNICATION SYSTEMS AND METHODS

This application claims priority to PCT Patent Appln. No. PCT/GB2017/053211 filed Oct. 25, 2017, which claims priority GB Patent Appln. No. 1617956.6 filed Oct. 25, 2016, which are herein incorporated by reference.

BACKGROUND OF THE INVENTION

1. Technical Field

Described examples relate to systems, methods and other apparatus for use with wells, such as an oil and gas well. Some examples relate specifically to systems, methods and other apparatus for use with wells having open hole sections.

2. Background Information

Either when a well is drilled/completed, or at some point later in the life cycle of a well, sections of the well infrastructure may be uncased or without liner. That is to say that that the well infrastructure may comprises regions that are "open hole". Such open hole regions may exist in a pilot hole, or side track, or otherwise at the bottom of a well structure without a liner.

Further, at the end of the lifecycle of a well, or at the end of an appraisal process, or the like, steps may be taken to permanently abandon a well. Each territory in which the well and associated infrastructure is located will typically have its own abandonment requirements that may require different procedures to be adhered to during and/or following the abandonment process. The process of abandoning a well may differ somewhat depending on whether the well is onshore or offshore.

That said, it is not uncommon for there to be similar or overlapping procedures adopted in each of the above circumstances, which include isolating any freshwater zones associated with the well; isolating from the well any future production zones; preventing leaks to/from the well; and, in addition to removing wellheads, etc., also cutting and removing all well structure such as casing strings, etc., to a particular level below the surface.

It will be appreciated that the surface or ground region associated with an onshore well may relate to the surface from which the well structure extends into ground and then down to the formation, whereas for an offshore well, the surface or ground region may relate to the mudline, or the like, again from which well structure extends down to the formation below.

In addition, a particular type of well is an appraisal (or exploration) well which may be drilled as part of an appraisal process to determine the extent and reserves at a particular field. Appraisal wells may comprise a section having a metallic well structure, such as a conductor or casing, and an open hole section having no metallic well structure. Once the appraisal process is complete, appraisal wells are typically abandoned also. The abandonment process may include pumping a first plug, which may comprise cement, into the open hole section and positioning a second plug, which may also comprise cement in the metallic well structure section.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY OF THE INVENTION

In described examples, there are systems and methods for deployment in proximity to an abandoned well. The systems and methods may allow use of data collected from an abandoned well, in which a sensor is positioned in the open hole section, or a well having a discontinuous metallic well structure.

In some examples, there is described a communication system that is configured to be deployed in an abandoned well having a discontinuous metallic well structure that may be severed below a ground region.

According to an aspect, there is provided a communication system for use in conjunction with a well having a metallic well structure therein, the system comprising: a downhole apparatus configured to be positioned within the well below the metallic well structure, the downhole apparatus being further configured to wirelessly transmit data signals for propagation via the metallic well structure; and at least one receiver configured to be deployed at a top of the well, and further configured to receive the data signals from the metallic well structure.

Optionally, the system further comprises a communications device configured to receive the wirelessly transmitted data signals from the downhole apparatus and to inject the data signals into the metallic well structure for propagation therethrough.

Optionally, the communications unit is configured to be in contact with the metallic well structure for injecting the data signals into the metallic well structure.

Optionally, the communication unit is configured to modulate the wirelessly received data signals for injection into the metallic well structure for reception by the at least one receiver.

Optionally, the downhole apparatus is configured to wirelessly transmit the data signals up to 500 meters.

Optionally, the well is an abandoned well comprising a first plug, the downhole apparatus being configured to be positioned below the first plug and to wirelessly transmit the data signal through the first plug.

Optionally, the abandoned well further comprises a second plug, and wherein the communications device is configured to be positioned above the first plug and below the second plug.

Optionally, the metallic well structure is severed below a surface, and wherein the at least one receiver is configured to be deployed at a ground region in proximity to the well for receiving the data signals from the metallic well structure through the ground region.

Optionally, the at least one receiver is configured to receive the data signals from the metallic well structure through roughly 1 to 20 meters of ground region.

Optionally, the at least one receiver is configured to be fixed, or otherwise secured, to the ground region when deployed.

Optionally, the system comprises a plurality of receivers arranged spatially at the ground region in proximity to the abandoned well Optionally, the spacing between each of the receivers is at regular intervals.

Optionally, the system comprises a processing unit configured to receive and process data signals from the plurality of receivers so as to fuse the data signals from different receivers in order provide a data signal representative of the data signal injected to the metallic well structure of the well.

Optionally, the processing unit is configured to correlate the data signals received from different receivers in order provide a data signal representative of the data injected to the metallic well structure of the well.

Optionally, the plurality of receivers are configured to receive the data signals using at least two different receiving methods.

Optionally, the plurality of receivers comprises a receiver including an electrode configured to receive data signals using a first receiving method, and/or a receiver including a loop antenna configured to receive data signals using a second receiving method.

Optionally, the processing unit is configured to process data from one or more of the receiving methods.

Optionally, the at least one receiver is configured to be deployed in a body of water and is configured to be deployed at a seabed or mudline in proximity to the well.

Optionally, the system comprises a transmitter configured to transmit data received by the receivers for subsequent receipt at a remote location.

Optionally, the data signals are electromagnetic (EM) data signals.

Optionally, the at least one receiver is configured to receive EM data signals having a frequency in the region of a range from 0.05 Hz to 10 Hz.

Optionally, the downhole apparatus is configured to be positioned in an open-hole section of the well.

Optionally, the downhole apparatus comprises a sensor configured to sense one or more of temperature and pressure within the well.

According to an aspect, there is provided a method for determining whether there is connectivity between a plurality of subterranean reservoirs of hydrocarbon material, each reservoir intercepted by at least one of a plurality of appraisal and/or production wells, wherein at least one of the plurality of wells has a communication system according to any disclosed in this document fitted therein, the method comprising: altering a parameter in a first reservoir intercepted by a first well of the plurality of wells, wherein the altered parameter in the first reservoir is detectable by a downhole apparatus of a communications system fitted within a second well; sensing a corresponding parameter in a second reservoir intercepted by the second well using the downhole apparatus of the communications system fitted within the second well for determining whether there is connectivity between the first and second reservoirs.

Optionally, the altered parameter comprises pressure, and wherein the pressure in the first reservoir is altered by injection of a substance into the first well or removal of a substance from the first well.

Optionally, altering the pressure in the first reservoir comprises injecting water into the first reservoir via the first well.

Optionally, the second well is an abandoned well and optionally an abandoned appraisal well.

Optionally, the second well comprises an open hole section that intercepts the second reservoir, and wherein the downhole apparatus is located in the open hole section.

According to an aspect, there is provided a method of abandoning a well comprising a metallic well structure section and an open hole section, the method comprising: positioning a downhole apparatus in the open hole section, wherein the downhole apparatus is configured to wirelessly transmit data signals for transmission via a metallic well structure of the metallic well structure section; and deploying at least one receiver at a top of the well, the at least one receiver configured to receive the data signals from the metallic well structure.

Optionally, the method comprises positioning a communications device in the metallic well structure section, wherein the communications device is configured to receive the wirelessly transmitted data signals from the downhole apparatus and to inject the data signals into the metallic well structure of the metallic well structure section for propagation therethrough.

Optionally, the method comprises positioning a first plug above the downhole apparatus and optionally positioning a second plug above the communications device.

Optionally, the method comprises severing the metallic well structure of the well below a surface, and wherein deploying the at least one receiver comprises deploying the at least one receiver at a ground region in proximity to the well for receiving the data signals from the metallic well structure through the ground region.

According to an aspect, there is provided an abandoned well comprising a communications system according to any disclosed herein.

In some examples, there is described a computer program product that when programmed into a suitable controller configures the controller to perform any methods disclosed herein. There may be provided a carrier medium, such as a physical or tangible and/or non-transient carrier medium, comprising the computer program product. The carrier medium may be a computer readable carrier medium.

The invention includes one or more corresponding aspects, embodiments or features in isolation or in various combinations whether or not specifically stated (including claimed) in that combination or in isolation. As will be appreciated, features associated with particular recited embodiments relating to systems may be equally appropriate as features of embodiments relating specifically to methods of operation or use, and vice versa.

It will be appreciated that one or more embodiments/aspects may be useful in effective monitoring of a well, in particular abandoned wells, and may help monitor conditions accurately, for example, after the life of any well.

The above summary is intended to be merely exemplary and non-limiting.

BRIEF DESCRIPTION OF THE DRAWINGS

A description is now given, by way of example only, with reference to the accompanying drawings, in which.

DETAILED DESCRIPTION OF THE INVENTION

For ease of explanation, the following examples have been described in relation to an offshore well and well structure extending below a mudline, or the like. However, systems and methods described herein may be equally used and applicable in respect of onshore wells. Similarly, while the following examples may be described in relation to oil and gas wells, and in particular production and appraisal wells, the same systems and methods, etc., may be used beyond oil and gas applications. A skilled reader will be able to implement those various alternative embodiments accordingly.

Similarly, some of the following examples have been described in relation to wells having sections that are open hole specifically with reference to appraisal wells, or the like. However, it will be appreciated that aspects of the following systems and methods may equally be used with other wells and well structures having open hole sections, such as production wells, injections wells, or the like, or pilot holes, side tracks, etc.

Generally, disclosed herein are methods and systems for communicating data signals from downhole to at least one receiver at a ground region near the well. In particular, methods and systems disclosed are arranged to communicate data signals from a well having a discontinuous metallic well structure meaning that the metallic well structure cannot be used as a sole medium to propagate the data signals from downhole to the receivers at the surface. For example, in wells having an open hole section, methods and systems disclosed may be arranged to communicate data signals from the open hole section to the at least one receiver. It is noted that the well structure need only be suitable for propagating EM signals and need not be metallic.

Figures 1A, 1B, 1C:
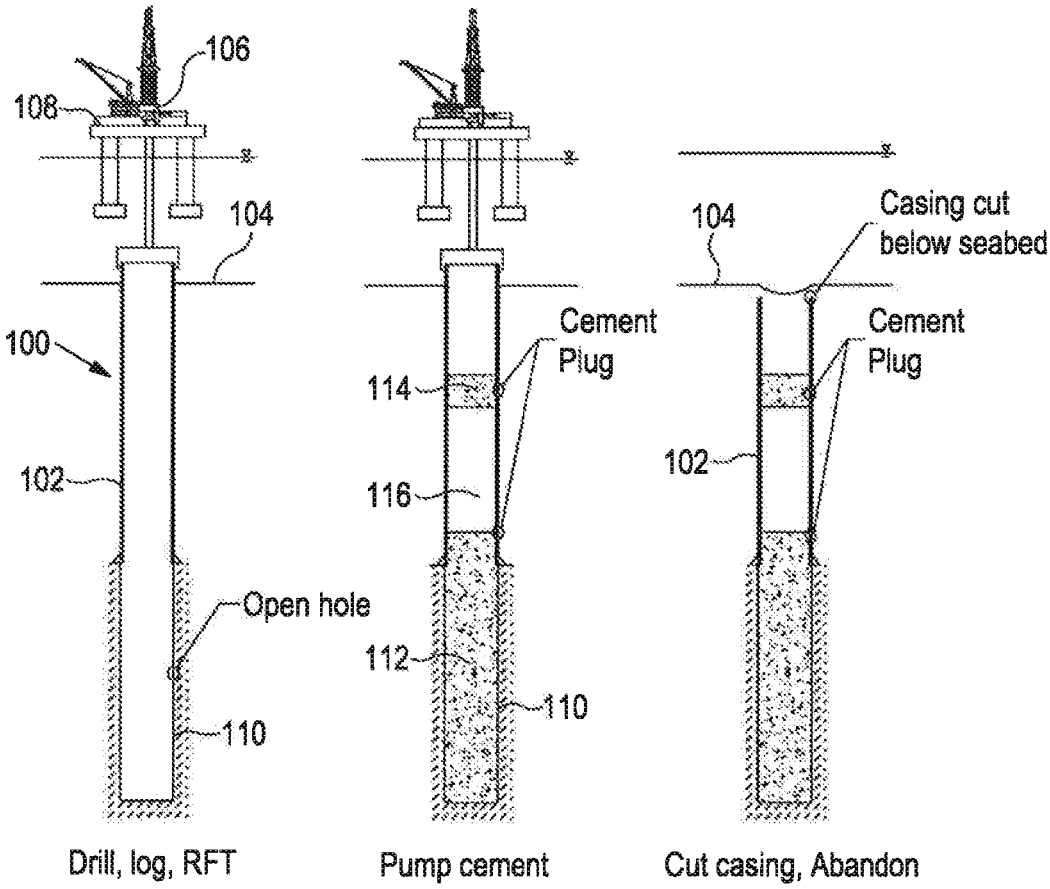
FIG. 1A shows an exemplary appraisal well structure.
FIG. 1B shows an exemplary appraisal well structure after first and second cement plugs have been positioned therein.
FIG. 1C shows an exemplary appraisal well structure in which a metallic well structure has been severed below the seabed.

FIG. 1A shows a simplified representation of a section of a well 100, and in this case an offshore appraisal well 100. A metallic well structure 102 extends from the surface—in this case the seabed or mudline 104—to a subterranean formation, as will be appreciated. Such well structure 102 can include conductor, casing and other tubing used to recover product from the formation. In this example, the well 100 comprises a wellhead 106, wet tree or the like, at a production platform 108. In other examples, the wellhead/tree arrangement 106 may be provided at the mudline 104. A lower section 110 of the well 100 is open hole, in that there is no well structure positioned within the well in this section.

Referring to FIG. 1B, and as explained briefly above, when the appraisal well 100 is abandoned, a first cement plug 112 is typically formed at or just above the open hole section 110 of the well 100. The first cement plug may be formed by pumping wet cement into the well 100. Typically, a second cement plug 114 is formed above the first cement plug 112. An intermediate section 116 of the well 100 forms an enclosed space between the first and second plugs 112, 114.

Referring to FIG. 1C, a final stage of the abandonment process comprises severing the metallic well structure 102 below the seabed or mudline 104.

Appraisal wells cost a significant sum of money to drill. In known arrangements, the value of an appraisal well for data gathering ceases on pumping cement. The inventors have appreciated that that more data can be extracted from an appraisal well after abandonment. For example, pressure and temperature within the appraisal well could be monitored post-abandonment, which would provide additional information about connectivity/compartmentalization of a reservoir with follow-on appraisal wells or nearby production wells.

Exemplary methods and apparatus may be configured to wirelessly provide downhole data to a surface from or through an open hole section or sections of an abandoned well, which may be permanently abandoned and have one or more metallic well structures (e.g. casing strings) severed below the surface, as shown in the exemplary arrangement of FIG. 1C.

Therefore, exemplary methods and systems disclosed herein allow utilization of an appraisal well beyond its abandonment. A communication system is disclosed that permits data signals transmitted wirelessly by a downhole apparatus, such as a sensor or gauge, positioned in an open hole section of the well to be communicated to systems and apparatus at or above the seabed.

Downhole data from the open hole section of the well may be communicated using an electromagnetic (EM) method. For example, an EM gauge or sensor in the open hole section may be configured to create a dipole antenna that wirelessly transmits data signals through the surrounding formation. The wirelessly transmitted data signal may be received by a communications device placed in the metallic well structure and re-transmitted through the metallic well structure to systems and apparatus at the surface. In some respects, the communications device may therefore be considered to be or to comprise a relay.

As used herein, the term "wireless" when applied to communications encompasses all transmission that is not through a guided transmission medium, such as a wire, other metallic structure or a material having high EM conductivity relative to a surrounding medium. Wireless communications may, for example, be through air, water, ground (or formation) or another medium that has substantially isotropic EM conductivity.

The EM signal from the communications device may be received by one or more surface/seabed receivers. In exemplary arrangements in which the metallic well structure is severed below the surface, the data signals re-transmitted through the metallic well structure may be received by a plurality of receivers arranged at the surface/seabed, as described below.

In other arrangements, the wireless data signals transmitted by the downhole apparatus may be received by the metallic well structure itself and communicated to the surface via the metallic well structure In exemplary arrangements, communications can be duplex. That is, the surface receiver(s) may be transceivers configured to transmit data signals to the sensor or other apparatus within the well, as explained in more detail below.

Figure 2:
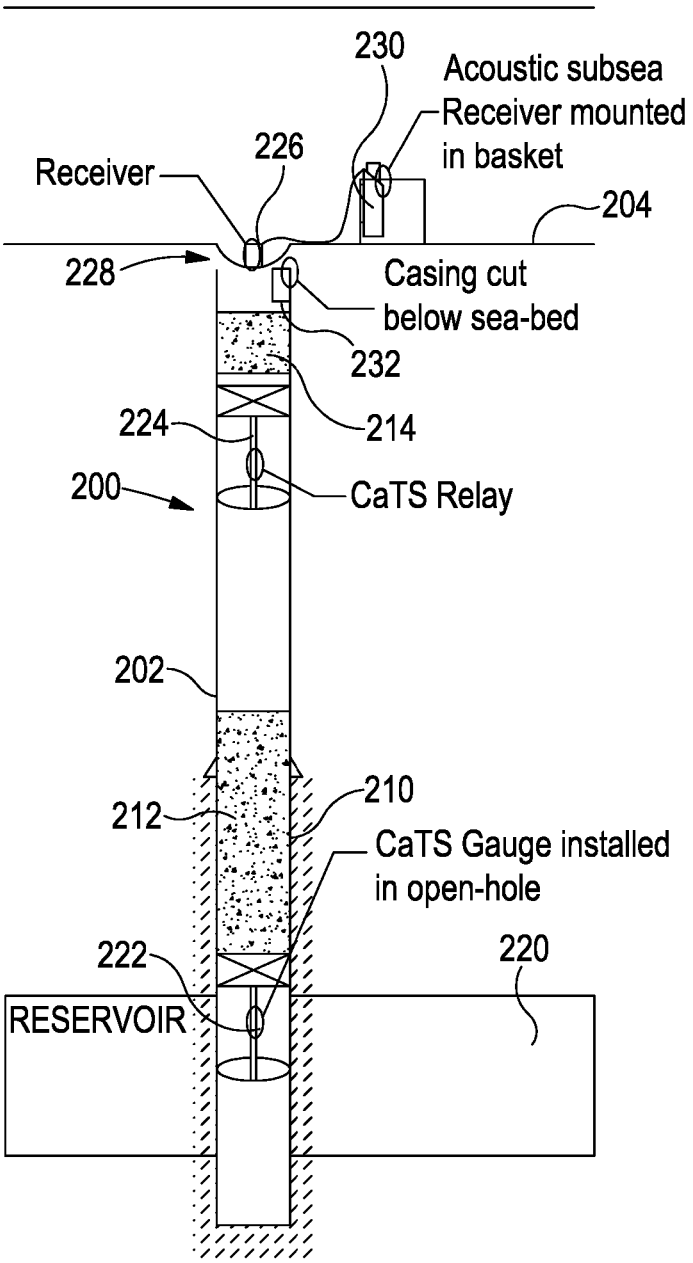
FIG. 2 shows an exemplary well having a communication system fitted therein.

Referring to FIG. 2, a well 200 intercepts a reservoir 220. The reservoir 220 may comprise hydrocarbon material. The reservoir 220 is intercepted by an open hole section 210 of the well 200. The well 200 has been abandoned and the metallic well structure 202 has been severed below the seabed or mudline 204.

The well 200 has fitted therein a communications system comprising a downhole apparatus 222, which in this case comprises a sensor, a communications device 224 and one or more receivers 226. The downhole apparatus 222 is configured to wirelessly transmit data signals through the well 200. The downhole apparatus 222 may, for example, be configured to sense temperature and/or pressure in the open hole section 210 of the well 200 and to transmit data signals indicative of the sensed temperature and/or pressure.

Therefore, in exemplary methods and systems, the downhole apparatus 222 comprises a sensor configured to sense a downhole parameter, such as temperature and/or pressure. The downhole apparatus may further comprise a transmitter configured to wirelessly transmit a data signal indicative of the sensed parameter for receipt by a communications device 224. The transmitter may be configured to transmit the data signal indicative of the sensed parameter at frequencies up to 50 Hz. Further, the transmitter may be configured to transmit the data signal indicative of the sensed parameter over a distance of up to several hundred meters, for example, up to 500 meters.

The downhole communication device 224 is configured to receive the wirelessly transmitted data signals and to communicate corresponding data signals to the metallic well structure 202 for transmission to a receiver 226. In exemplary methods and systems, the communications device 224 may be configured to inject data signals into the metallic well structure 202, thereby using the metallic well structure 202 as a signal path. Accordingly, the communications device 224 may comprise a data processing unit configured to process the wirelessly received data signals into a format suitable for transmission via the metallic well structure 202.

In the example of FIG. 2, the receiver 226 is positioned at the mudline 204, and is in signal communication with the metallic well structure 202. The downhole communications device 224 is arranged within the bore of the metallic well structure 202 and, as described above, may be configured to measure, or otherwise obtain from the downhole apparatus, well conditions such as temperature and/or pressure.

In exemplary arrangements, the downhole communications device 224 is configured to communicate electrical signals to well structures, and in particular to communicate signals to the metallic well structure 202 (e.g. tubing). In other words, the metallic well structure 202 may itself form the signal path, rather than a dedicated cabling system or the like. As such, in exemplary arrangements, the downhole communications device 224 is both in physical and electrical contact with the metallic well structure 202 so as to be able to propagate the data signals therethrough.

While the communications device 224 in FIG. 2 is shown as being within the well 200 itself, it will be appreciated that in other examples the communications device 224 may be formed as part of a downhole tool, barrier or the like (e.g. formed together with a plug). In any event, in use, the communications device 224 is configured to communicate data signals to the receiver 226 at surface 204. The data signals may relate to well conditions downhole, which can then be processed and/or determined at the surface 204 in order to maintain appropriate operation of the well 200, and/or to provide information permitting informed decisions regarding interventions or work overs, etc. In some examples, the data signals may additionally or alternatively be communicated from the surface 204 to the downhole communication device 224 and on to the downhole apparatus 222 in a similar manner. In some cases, the downhole apparatus 222 may be a downhole tool, or other actuation device, and operation thereof may be effected by communicating signals in this manner to the downhole communication device 224 and on to the downhole apparatus 222.

After abandonment of the well 200, some of the metallic well structure 202 may be severed at a depth below the surface 204, and the severed well structure removed. As such, a ground region 228 extends from surface 204 to the severed metallic well structure 202 that remains after abandonment. A discontinuity in signal path provided by the metallic well structure is now apparent.

The system comprises one or more receivers 226 configured to be deployed at the ground region 228 in proximity to the abandoned well 200, and in particular, in proximity to the severed metallic well structure 202. In the example shown in FIG. 2, one receiver 226 is deployed but, as will be described later, more may be used. The receiver 226 is configured to receive data signals from the metallic well structure 202 of the abandoned well 200 via the ground region 228. The system further comprises a processing unit 230 in communication with the receiver 226 and configured to receive and process data signals from the receiver 226. The processing unit 230 may comprise dedicated hardware and/or firmware configured to process data accordingly. The processing unit 230 may comprise a processor and memory arranged operatively together in a known manner.

The receiver 226 is configured to receive data signals from the metallic well structure 202 of the abandoned well through roughly 1 to 20 meters of ground region 228 (e.g. in this case from 2 to 10 meters of ground region 228). The ground region 228 may comprise seabed, or other such material, that is used to cover the severed well structure 202.

The receiver 226 may be configured to receive EM data signals from the metallic well structure 202 of the well via the ground region 228. In particular, the receiver 226 may be configured to receive data signals having a frequency of in the region of a range from 0.05 Hz and 10 Hz, such as from 0.1 Hz and 5 Hz, or the like.

The receiver 226 is configured to be fixed, or otherwise secured, to the ground region 228 when deployed. In some examples, the system may comprise one or more earth spikes, or the like, configured to provide a grounded potential. This may help in relation to signal reference purposes for the receiver 226 (e.g. particularly when receiving EM data signals from the well structure 202).

The communication system may comprise a plurality of receivers 226. The system—and in this example the processing unit 230—can be configured to process, or otherwise merge or fuse, data signals received using each of the plurality of receivers 226. In the example shown, the processor 230 may be configured to correlate data signals received using different receivers 226. By processing data signals received at multiple receivers 226, a data signal representative of a signal having initially been communicated to the metallic well structure 202 of the abandoned well 200 (e.g. and subsequently received via the ground region 228) can be obtained. In such a way, the signal-to-noise ratio can be improved, compared to using only a single receiver 226, which may be helpful given that some of the signal path now comprises the ground region 228. Further, the ease with which the system can be deployed, yet still being able to obtain a suitable signal is improved, compared to deploying a single receiver 226, given that at least one receiver will be more likely to be favorably positioned relative to the (now covered) severed well structure 202.

In this manner, data can be collected from an abandoned well 200 from data signals received from the metallic well structure 202 of the abandoned well 200 via a ground region 228, specifically using a plurality of receivers 226 deployed in proximity to the abandoned well 200. As such, conditions of the abandoned well 200 can be monitored using the collected data. It will be appreciated that the collected data may comprise data associated with temperature and/or pressure at regions within the abandoned well 200, and in fact the conditions of the well may relate to barrier integrity, or the like, which may be an important consideration for long term monitoring of such wells. In specific exemplary methods and systems, the temperature and/or pressure data may have been collected by the downhole apparatus 222, which is positioned in an open hole section 210 of the well 200.

In exemplary arrangements, the at least one receiver 226 may be configured as a transceiver and may therefore comprise a transmitter configured to transmit data signals towards the downhole apparatus 222. As such, the transmitter of the at least one transceiver 226 may wirelessly transmit data signals into the ground region 228, which may be received by the communications device 224 after propagation through the metallic well structure 202 or may be received by a repeater 232 (explained below), which is configured to inject the data signals into the metallic well structure 202 for propagation therethrough and reception by the communications device 224. The communications device 224 therefore comprises a receiver configured to receive data signals from the metallic well structure 202. The communications device may also comprise a transmitter configured to wirelessly transmit the data signals to the downhole apparatus 222.

While in FIG. 2 the system is shown as having one receiver 226, it will be appreciated that some examples the system may comprise more than one receiver 226.

In addition, a plurality of downhole apparatus 222 may be positioned in the open hole section 210 of the well 200. In such arrangements, one or more of the downhole apparatus 222 may comprise sensors for sensing a parameter of the reservoir and/or the well, such as temperature and/or pressure. Further, one or more of the downhole apparatus 222 may be configured to act as a repeater comprising a receiver configured to receive wirelessly transmitted data signals from another of the downhole apparatus 222 and a transmitter configured to wirelessly retransmit the received data signals to another of the downhole apparatus 222, a communication device 224 and/or the metallic well structure 202.

Further, a plurality of communications devices 224 may be positioned within the well 200 and in specific arrangements in the metallic well structure section of the well 200. Each of the communications devices 224 may be configured to act as a relay and may therefore comprise a receiver configured to receive data signals either wirelessly transmitted by a downhole apparatus 222, the at least one receiver (when configured as a transceiver) 226 or transmitted by another of the communications devices 224. The communications devices may also comprise a transmitter configured to retransmit the data signals via the metallic well structure to another of the communications devices 224 or the at least one receiver 226, or may transmit the data signals wirelessly to the one or more downhole apparatus 222.

Figure 3A:
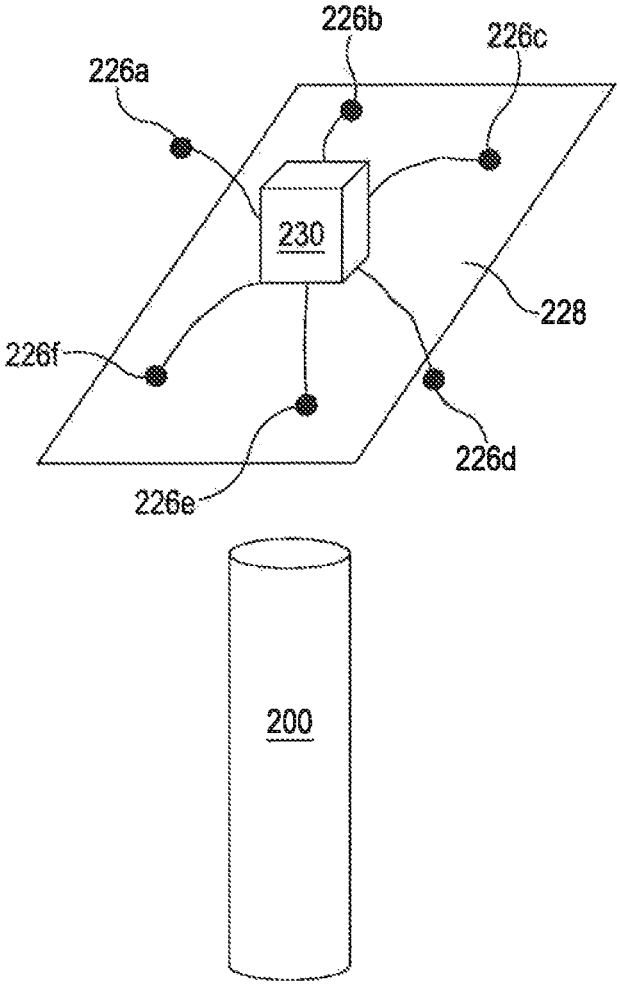
FIGS. 3A and 3B show further examples of the communication system.

By way of an example, FIG. 3A shows a plurality of receivers 226*a*-226*f* configured such that, when deployed, each of the plurality of receivers are arranged spatially at the ground region 228 in proximity to the abandoned well 200. In other words, the system may be configured such that the plurality of receivers 226*a*-226*f* are configured in an array, or the like, at the ground region 228 in proximity to the abandoned well 200. The relative spacing between each receiver 226*a*-226*f*, or otherwise the position of each receiver 226*a*-226*f*, may be known or predefined. In the example shown in FIG. 3A, the spacing between each of the receivers 226*a*-226*f* may be considered to be regular (e.g. spaced at regular intervals from one another).

Figure 3B:
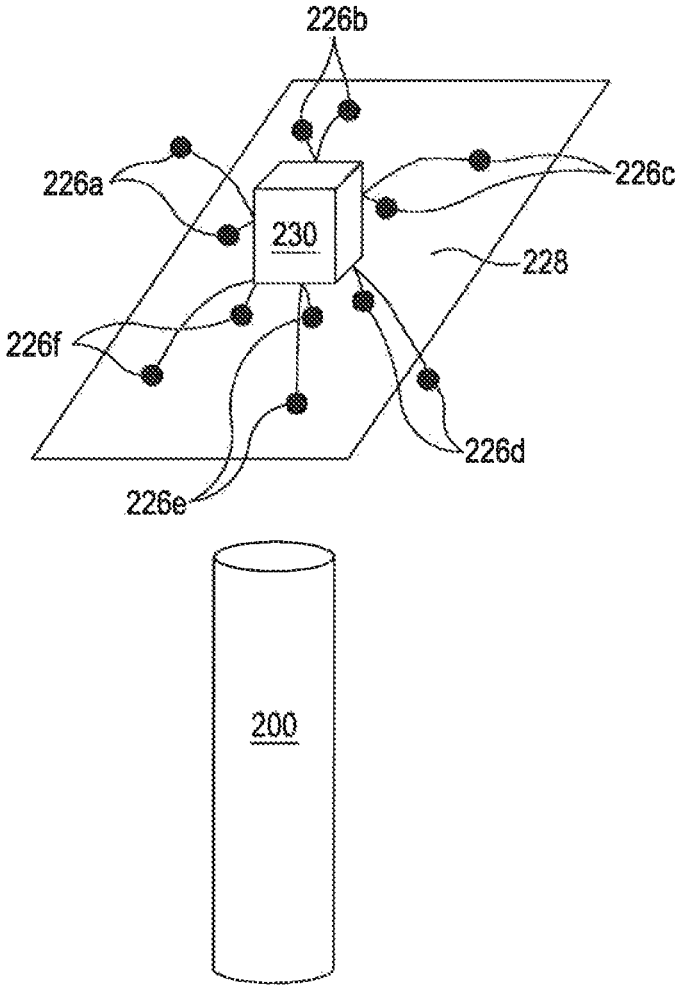

In FIG. 3A, each of the receivers 226*a*-226*f* may be configured to measure a potential difference between an electrode formed with the receiver 226*a*-226*f* and a common potential at the processing unit 230, or the like. Alternatively, and as is shown in FIG. 3B, each receiver 226*a*-226*f* may comprise two electrodes, and be configured to measure the potential difference therebetween.

In some examples, the processing unit 230 may be further configured to store data for subsequent collection/processing. In some cases, the processing unit 230 may comprise a transmitter configured to communicate data, for example by acoustically, for subsequent receipt and analysis. The processing unit 230 may be configured to communicate via a body of water (e.g. wirelessly) for subsequent receipt at a remote location. That remote location may include a receiving vessel or the like.

It will be appreciated at that the processing unit 230 may be configured to communicate processed data when requested to do so, or automatically from time to time, e.g. at regular intervals or when the data is requested by another entity.

In some examples, the receiver(s) 226, may be configured to receive data signals having been transmitted from the metallic well structure 202 via the ground region 228 using a repeater unit 232. That repeater unit 232 may be positioned at the metallic well structure 202. In such examples, the repeater unit 232 may be configured to receive data signals at the well structure 202, and improve the data signal quality (e.g. amplify, reduce/cancel noise) prior to communication to the ground region 228. In some examples, those data signals may be directly communicated to the ground region 228 using the repeater unit 232, or otherwise the repeater unit 232 may be positioned such that signals are communicated back to the metallic well structure 202 for subsequent transmission to the ground region 228.

While in some cases, such repeater units 232 may be provided during normal operation of the well, in other cases the repeater unit 232 may be deployed around the time of well abandonment. As such, the repeater unit 232 may be considered to form part of the overall communication system.

Either way, the repeater unit 232 may be configured to modify data signals being communicated in the metallic structure for transmission via the ground region 228. For example, the repeater unit 232 may be configured to amplify and/or modulate data signals having been communicated in the metallic well structure 202 for improved communication via the ground region 228. This may be particularly true for repeater units 232 that are deployed around the time of abandonment. In some cases, such repeater units 232 may be configured to convert the frequency of the signal, and/or convert the signal from one signal type (e.g. EM) to another signal type (e.g. acoustic) to assist with transmission, as will be appreciated.

While in some examples the receiver(s) 226 may be configured similarly, e.g. to receive similar data signals, similar frequencies, etc., in other examples this need not be the case.

Figure 4:
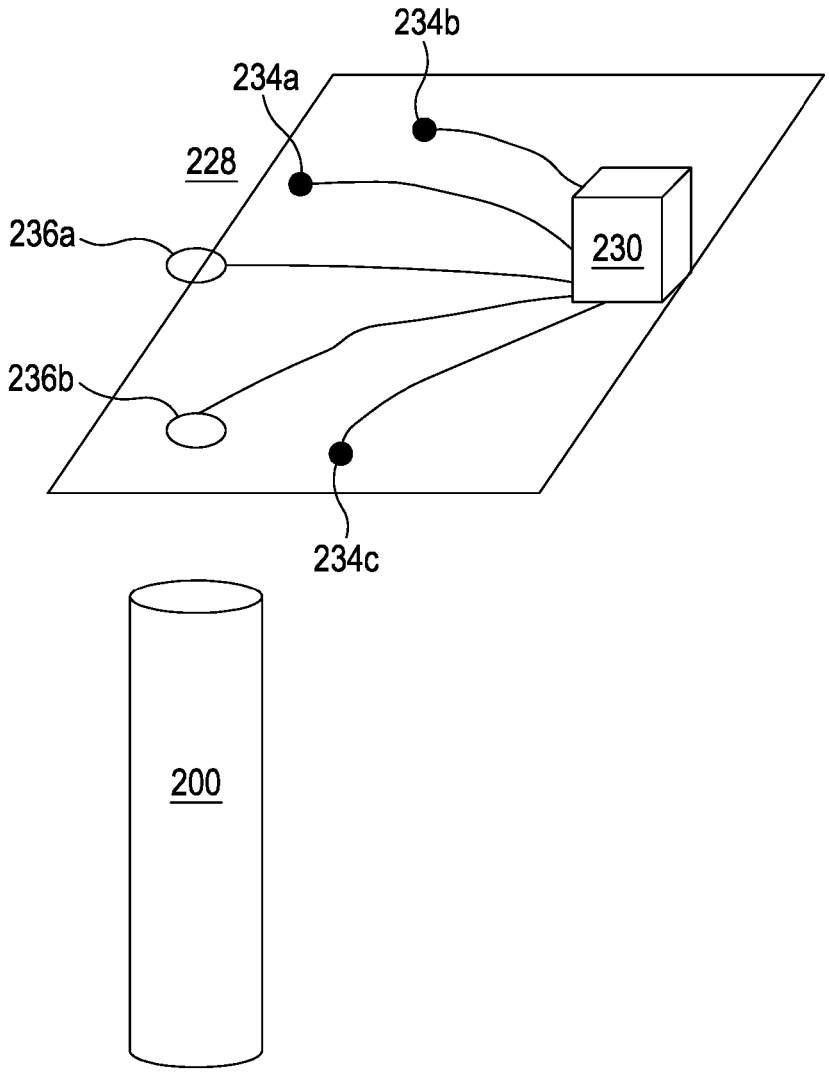
FIG. 4 shows a further example of the communication system.

FIG. 4 shows the plurality of receiver types 234, 236 configured to receive data signals using at least different receiving methods. Here, at least one receiver 234*a*-234*c* is configured to receive data signals using a first receiving method while at least one further receiver 236*a*-236*b* is configured to receive data signals using a second receiving method. In the example shown in FIG. 4, there are two types of receivers provided, a first type 234*a*-234*c* provided as an electrode configured to measure a potential difference (e.g. between an electrode and an earth point), and second type 236*a*-236*b* configured as a loop antenna, or the like, configured to measure variation in magnetic field.

In FIG. 4, and by way of an example, while the processing unit 230 is offset somewhat from the abandoned well 200, it will be appreciated that the system may still be considered to be deployed in proximity to the well 200.

When the system is configured to use at least two receiving methods, the processing unit 230, in communication with the receivers 234*a*-234*c*, 236*a*-236*b* is configured to receive and process data signals having been received from two or more receivers using those different receiving methods. In such cases again, the system—and in particular the processing unit 230—may be configured to process, or otherwise merge or fuse, data signals received using the different receiving methods. By using multiple methods in this manner, the outcome of such processing may provide a processed data signal more representative of a signal having initially been communicated to the metallic well structure 202 of the abandoned well 200, and subsequently received via the ground region 228. In some examples, it may be possible to selectively choose which data/receiver type to use in any subsequent analysis (e.g. based on signal/data quality).

While in the above examples, the system is shown as being deployed in proximity to single abandoned well 200, it will be appreciated that in some examples, the system may be deployed in proximity to multiple abandoned wells, and may be configured to receive data signals therefrom. Further, while in the above examples, the system is configured to receive data signals it will also be appreciated that in other examples, the system may additionally or alternatively be configured to communicate data signals for transmission through a ground region 228 and metallic structure 202, for subsequent receipt at a downhole communication device 224. The downhole communications device 224 may be configured to transmit wirelessly the data signals to the downhole apparatus 222. Further still, while each of the plurality of receivers are shown as discrete, it will be appreciated that they may be deployed together in a combined array.

While it has been described that the processing unit 230 performs some data processing, it will be appreciated that in other examples, the data may be processed at the processing unit 230 in as much as it is received at the processing unit 230, and then additionally or alternatively stored/communicated in raw format, or close to raw format, for subsequent processing an analysis.

In any event, the collected (and processed data) may be used to monitor conditions at an abandoned well, by collecting data associated with an abandoned well, and looking for changes in that data that may relate to underlying changes in the conditions of the well (e.g. loss of barrier integrity, etc.). The collected data may comprise data associated with temperature and/or pressure at regions within the abandoned well 200.

It will be appreciated that exemplary systems and methods may not require the use of the communications device 224. In such arrangements, the downhole apparatus 222 may be configured to transmit wireless data signals for receipt by the metallic well structure 202. The data signals propagate through the metallic well structure 202 and are received by the receiver 226. The receiver 226 may be in direct electrical communication with the metallic well structure 202, or may be separated from the metallic well structure 202 by the ground region 228 if the metallic well structure is severed below the surface 204.

Further, the communications system may be used in any circumstance in which there is a discontinuous metallic well structure that cannot, therefore, act as a sole transmission medium from the downhole apparatus 222 to the receiver 226, optionally via the communications device 224. In the exemplary systems and methods described above, the discontinuous nature of the metallic well structure is represented by the end of the metallic well structure 202 and the open hole section 210 of the well 200, but this is exemplary only.

Figure 5:
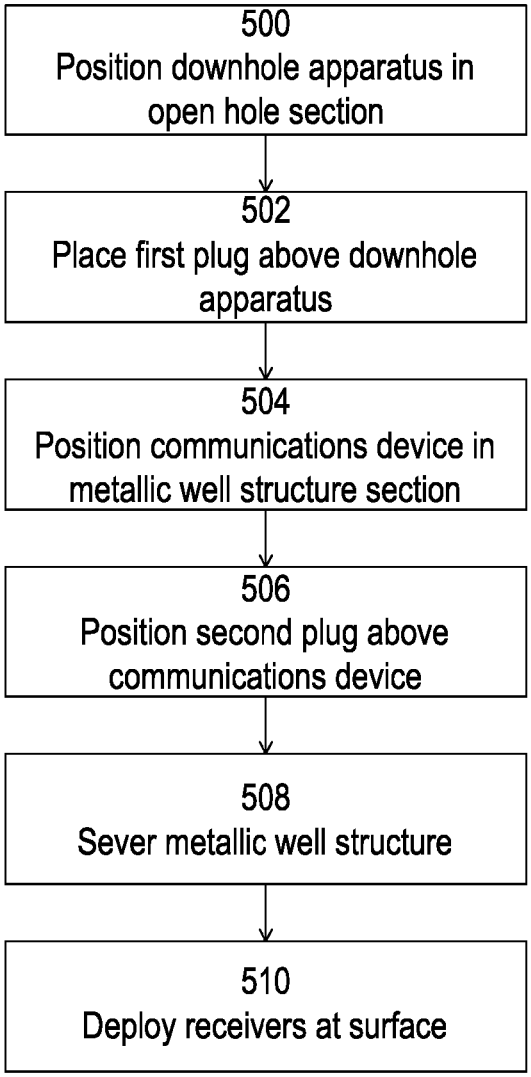
FIG. 5 shows a flow diagram of a method for abandoning a well.

FIG. 5 shows a flow diagram for a method of abandoning a well including an open hole section and a metallic well structure section. The method comprises positioning 500 a downhole apparatus 222, such as a sensor or an EM tool (e.g. CaTS), in the open hole (i.e. no liner required) section.

Once the downhole apparatus 222 is positioned within the well 200, a first plug 212 is placed 502 on top of the downhole apparatus 222. The first plug may comprise an inflatable element (or equivalent) and a cement portion, wherein the cement is poured into the well 200 after the inflatable element is positioned.

In exemplary arrangements in which a communications device 224 is used, the communications device 224 is positioned 504 above the first plug 212. The communications device 224 is positioned in the metallic well structure section, which comprises a casing, conductor or the like. As discussed above, the communications device 224 may be used to boost data signals transmitted wirelessly from the downhole apparatus 222 for transmission to the receiver 226 at the seabed.

A second plug 214 is placed 506 above the communications device 224 and the metallic well structure 202 is severed 508 below the surface 204.

The receiver(s) 226 are deployed at the surface 204 for receiving signals propagated through the ground region 228. Signal reception is through the ground region, i.e. there is no requirement for direct contact with the metallic well structure.

Figure 6:
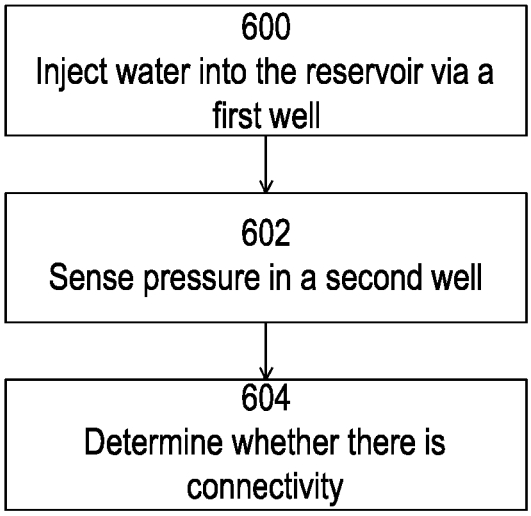
FIG. 6 shows a flow diagram of a method for detecting connectivity between reservoirs.

FIG. 6 shows a method for determining whether there is connectivity between subterranean reservoirs of hydrocarbon material intercepted by a plurality of wells. That is, reservoirs that are intercepted by separate wells may be connected together and/or may be part of the same reservoir. The method shown in FIG. 6 allows the determination of whether the reservoirs are connected. It is noted that the "reservoirs" intercepted by the two wells may in fact be a single reservoir, if it is determined that they are connected and the term "reservoirs" is used for ease of description only.

Figure 7:
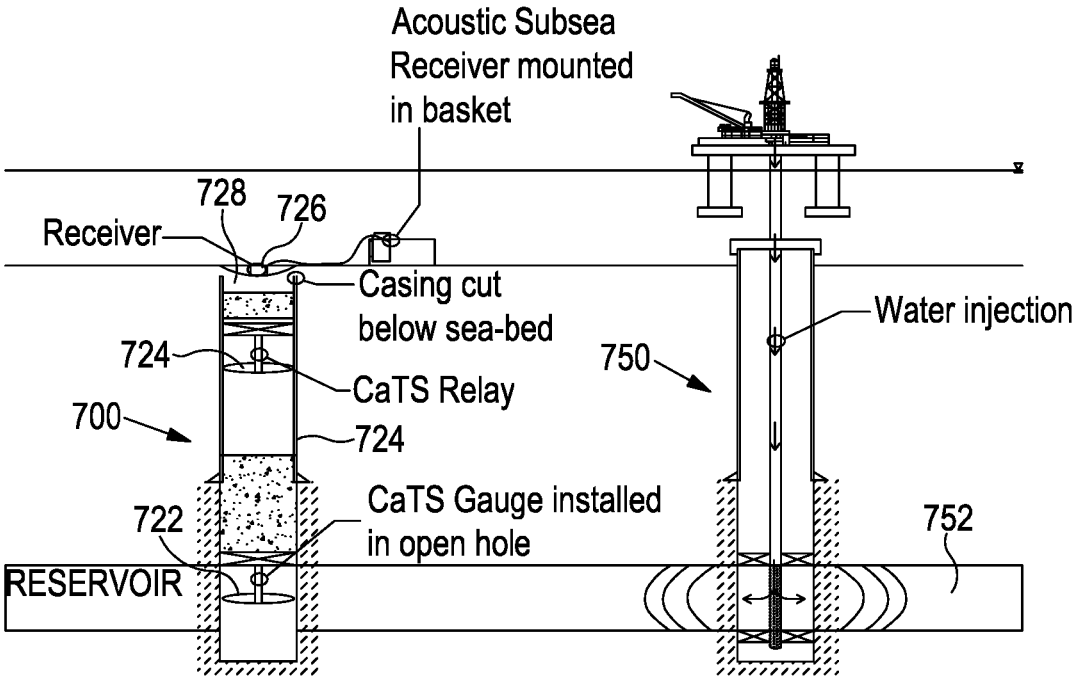
FIG. 7 shows an arrangement for determining connectivity between reservoirs.

FIG. 6 can be viewed in conjunction with FIG. 7, which shows a first well 700 and a second well 750. In the exemplary arrangement of FIG. 7, the first well 700 is an abandoned appraisal well and the second well 750 is a production well, although other well types may also be used. The first well 700 comprises a communication system as described herein. In particular, the first well 700 includes a downhole apparatus 722, a communication device 724 and at least one receiver 726, all configured to operate as disclosed herein. The first well 700 and the second well 750 each intercept a reservoir 752.

Water is injected 600 into the second well 750. This increases the pressure in the reservoir 752. The pressure in the reservoir 752 is one of a number of parameters that may be altered in the reservoir 752. Whichever parameter is altered, it should be detectable by the downhole apparatus 722. That is, the downhole apparatus 722 should comprise a sensor configured to sense a change in the chosen parameter and/or an associated parameter. In the case of FIGS. 6 and 7, the parameter is pressure and the downhole apparatus therefore comprises a pressure sensor for sensing a change in the pressure in the reservoir 752.

The parameter is altered via the second well 750. The parameter, or a corresponding parameter, is detectable by the communications system fitted to the first well 700. That is, the downhole apparatus 722 comprises a sensor configured to sense the parameter or a corresponding or related parameter. Accordingly, the downhole apparatus 722 senses 602 the pressure in the reservoir and communicates a data signal indicative of the pressure in the reservoir to the receiver 726 using any method disclosed herein. In the case of FIGS. 6 and 7, the downhole apparatus 722 wirelessly transmits the data signal to the communications device 724, which injects it into the metallic well structure 702. The data signal propagates through the metallic well structure 702 and then through the ground region 728 above the severed well structure 702 before being received at the receiver 726.

The received data is used to determine 604 whether the reservoirs intercepted by the first and second wells 700, 750 are connected.

The applicant discloses in isolation each individual feature described herein and any combination of two or more such features, to the extent that such features or combinations are capable of being carried out based on the specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description it will be evident to a person skilled in the art that various modifications may be made within the scope of the invention.

The invention claimed is:

1. A communication system for use in conjunction with a well having a signal path defined at least partially by a metallic well structure, the metallic well structure severed below a ground region surface, the well having an open-hole section disposed below the metallic well structure and a first plug disposed within the well, the system comprising:

a downhole apparatus configured to be positioned in physical electrical contact with the open-hole section and disposed within the well below the first plug, the downhole apparatus being further configured to wirelessly transmit data signals from or through the open-hole section, through surrounding formation and/or the first plug, for receipt at the metallic well structure for propagation via the metallic well structure as part of the signal path; and at least one receiver configured to be deployed at a top of the well proximate the ground region surface covering the metallic well structure, and further configured to receive the data signals from the ground region via the metallic well structure.

2. The system according to claim 1, further comprising a communications device configured to receive the wirelessly transmitted data signals from the downhole apparatus and to inject the data signals into the metallic well structure for propagation therethrough.

3. The system according to claim 2, wherein the communications device is configured to be in contact with the metallic well structure for injecting the data signals into the metallic well structure.

4. The system according claim 2, wherein the communication unit is configured to modulate the wirelessly received data signals for injection into the metallic well structure for reception by the at least one receiver.

5. The system according to claim 1, wherein the downhole apparatus is configured to wirelessly transmit the data signals up to 500 meters.

6. The system according to claim 1, wherein the at least one receiver is configured to receive the data signals from the metallic well structure through roughly 1 to 20 meters of ground region.

7. The system according to claim 1, wherein the at least one receiver is configured to be secured, to the ground region when deployed.

8. The system according to claim 1, comprising a plurality of receivers arranged spatially at the ground region in proximity to the abandoned well.

9. The system according to claim 8, further comprising a processing unit configured to receive and process the data signals from the plurality of receivers so as to fuse the data signals from different receivers in order provide a second data signal representative of at least one of the data signals injected into the metallic well structure of the well.

10. The system according to claim 8, wherein the plurality of receivers comprises a receiver including an electrode configured to receive the data signals using a first receiving method, and/or a receiver including a loop antenna configured to receive the data signals using a second receiving method.

11. The system according to claim 8, wherein the plurality of receivers are configured to receive the data signals using at least two different receiving methods.

12. The system according to claim 1, wherein the at least one receiver is configured to be deployed in a body of water and is configured to be deployed at a seabed or mudline in proximity to the well.

13. The system according claim 1, wherein the data signals are electromagnetic (EM) data signals and wherein the at least one receiver is configured to receive EM data signals having a frequency in the range of about 0.05 Hz to about 10 Hz.

14. The system according to claim 1, wherein the downhole apparatus is configured to be positioned in an open-hole section of the well.

15. A method for determining whether there is connectivity between a plurality of subterranean reservoirs of hydrocarbon material, each reservoir intercepted by at least one of a plurality of appraisal and/or production wells, wherein at least one of the plurality of wells has a communication system, the method comprising:

providing a first well within the plurality of wells with a communication system, the first well having a signal path defined at least partially by a metallic well structure, the metallic well structure severed below a ground region surface, the well having an open-hole section disposed below the metallic well structure and a first plug disposed within the well, the communication system including:

a downhole apparatus configured to be positioned in physical electrical contact with the open-hole section and disposed within the well below the first plug, the downhole apparatus being further configured to wirelessly transmit data signals from or through the open-hole section, through surrounding formation and/or the first plug, for receipt at the metallic well structure for propagation via the metallic well structure as part of the signal path; and at least one receiver configured to be deployed at a top of the first well proximate the ground region surface covering the metallic well structure, and further configured to receive the data signals from the ground region via the metallic well structure;

altering a parameter in a first reservoir intercepted by a second well of the plurality of wells, wherein the altered parameter in the first reservoir is detectable by the downhole apparatus of the communications system fitted within the first well;

sensing a corresponding parameter in a second reservoir intercepted by the first well using the downhole apparatus of the communications system fitted within the first well for determining whether there is connectivity between the first and second reservoirs.

16. The method according to claim 15, wherein the second well comprises an open hole section that intercepts the second reservoir, and wherein the downhole apparatus is located in the open hole section.

17. A method of abandoning a well having a signal path defined at least partially by a metallic well structure section and an open hole section, the method comprising:

positioning a downhole apparatus in physical electrical contact in the open hole section, wherein the downhole apparatus is configured to wirelessly transmit data signals from or through the open-hole section, through surrounding formation, for receipt at a metallic well structure for transmission via the metallic well structure of the metallic well structure section as part of the signal path; and deploying at least one receiver at a top of the well at a ground region covering the metallic well structure, the at least one receiver configured to receive the data signals from the ground region via the metallic well structure.

18. The method according to claim 17, further comprising:

positioning a communications device in the metallic well structure section, wherein the communications device is configured to receive the wirelessly transmitted data signals from the downhole apparatus and to inject the data signals into the metallic well structure of the metallic well structure section for propagation therethrough.

* * * * *